US005597085A

United States Patent [19]

Rauworth et al.

[11] Patent Number: 5,597,085

[45] Date of Patent: Jan. 28, 1997

[54] COMPOSITE, PRESSURE-RESISTANT DRUM TYPE CONTAINER

[75] Inventors: Barry L. Rauworth, Victoria; John M. Hennen, Eden Prairie, both of Minn.

[73] Assignee: Fluoroware, Inc., Chaska, Minn.

[21] Appl. No.: 278,023

[22] Filed: Jul. 20, 1994

[51] Int. Cl.[6] ..... B65D 7/00

[52] U.S. Cl. ..... 220/403; 220/601; 220/610; 220/622; 220/623; 220/628; 220/630; 220/639

[58] Field of Search ..... 220/407, 601, 220/503, 403, 610, 622, 623, 639

[56] References Cited

U.S. PATENT DOCUMENTS

| | | | |
|---|---|---|---|
| 3,501,047 | 3/1970 | Raabe . | |
| 3,501,055 | 3/1970 | Jurion et al. . | |
| 3,724,712 | 4/1973 | Starr et al. . | |
| 4,635,814 | 1/1987 | Jones . | |
| 4,767,021 | 8/1988 | Pies | 220/601 |
| 4,793,491 | 12/1988 | Wolf et al. . | |
| 4,840,284 | 6/1989 | Snyder | 220/601 |
| 5,014,873 | 5/1991 | Clemens et al. | 220/601 |
| 5,110,000 | 5/1992 | Nichols . | |
| 5,169,024 | 12/1992 | Rinkewich . | |
| 5,217,142 | 6/1993 | Schutz | 220/601 |
| 5,273,159 | 12/1993 | Gregerson . | |

OTHER PUBLICATIONS

Admitted Prior Art FIG. 1.
Admitted Prior Art FIG. 2.

*Primary Examiner*—Joseph M. Moy
*Attorney, Agent, or Firm*—Palmatier, Sjoquist & Helget

[57] ABSTRACT

A composite, drum type container for storing and dispensing corrosive fluids comprises an inner plastic liner of polyethylene and an outer plastic shell. The end walls of the outer shell are substantially dome-shaped to add strength to the container, and the top end wall is further reinforced by an inclined offset wall, ribs, and inwardly protruding portions of the sidewall, to prevent deformation. A separate pressure plate adds to the strength of the dome-shaped bottom end wall. A recess or well in the bottom end wall and pressure plate allows complete removal of the contents of the container.

23 Claims, 3 Drawing Sheets

COMPOSITE, PRESSURE-RESISTANT DRUM TYPE CONTAINER

BACKGROUND OF THE INVENTION

This invention relates to a composite, drum type container for storing and dispensing easily vaporizable fluids, and more particularly to a composite, drum type container comprising an inner corrosion-resistant liner and an outer shell designed to resist high internal pressure caused by vaporization of the fluid.

Containers, particularly large constructions useful for containing liquids and gases under high pressure, are at present usually built of metal and/or laminated composite materials because of the high resistance required in order to withstand high axial and radial pressures. Containers made of metal are very time-consuming and costly to build because of the need first to produce the various components of the container and then to assemble them together, e.g. by welding. Moreover, a high degree of expertise is required because if the welding (or other bonding technique) used for assembling the components together is not perfectly executed, leaks may develop during the use of the container. Further, metal containers tend to corrode, oxidize, pit or develop unpleasant odors or tastes, unless non-corrosive metals are used, such as stainless steel, or protective layers or coatings are applied, both of which substantially increase the expense and/or time in producing the containers. Corrosion or oxidation of metal containers can result in contamination of the liquid contents with metallic ions. Building containers made from laminated composite materials is also time-consuming, expensive and expertise-dependent because of the need to manufacture the components and then assemble them together.

Containers made of plastics such as polyethylene are known in the art, and such containers may be manufactured by rotational molding, which is a relatively low cost molding process. Such containers typically are composite in that they comprise an inner plastic liner and an outer, rigid plastic shell. The outer shell of the composite structure typically serves as protection of the inner liner as well as providing a means by which the container can be handled via drum handling equipment. While such plastic containers overcome many of the disadvantages of metal containers, it is difficult to construct a plastic container that will withstand high pressure, i.e., on the order of 43 p.s.i. The ability to withstand high pressure is important in containing chemical compounds, such as hydrochloric acid and ammonium hydroxide, which have high vapor pressures. If the container is not sufficiently rigid, the ends of the container may deform under high pressure, causing leakage and swelling, and preventing the container from fitting into existing, standard size bulk chemical delivery system cabinets. Further, such containers are often manufactured in non-standard shapes because of the requirements for both axial and radial rigidity, again preventing them from being fitted into standard delivery systems.

Another problem with existing chemical containers is that they typically have flat tops and bottoms. Not only are flat tops and bottoms subject to deformation under pressure, but they also prevent complete, i.e., 100% dispensing of the contained liquids and thorough rinsing of the container after dispensing the contained liquid.

There is a need for a composite, drum type plastic container of standard dimensions, i.e., no larger than a standard 55 gal. drum, with an improved ability to resist deformation caused by internal pressure. The container should be relatively inexpensive to manufacture, and should be capable of dispensing 100% of its contents and easy rinsing and cleaning. The container should also be pallet stackable with other containers of similar dimensions.

SUMMARY OF THE INVENTION

A composite, drum type container for storing and dispensing corrosive fluids comprises an inner plastic liner of polyethylene or equivalent material and an outer plastic shell. The end walls of the outer shell are substantially dome-shaped to add strength to the container, and the top end wall is further reinforced by an inclined offset wall, ribs, and inwardly protruding portions of the sidewall known as "kiss-offs," to prevent deformation. A separate pressure plate adds to the strength of the dome-shaped bottom end wall. A recess or well in the bottom end wall and pressure plate allows nearly complete removal of the contents of the container.

A principal object and advantage of the present invention is that it is constructed completely of plastic, with the exception of the fasteners, thereby resisting corrosion.

A second object and advantage of the present invention is that it has dome-shaped end walls which offer high resistance to deformation caused by internal pressure.

A third object and advantage of the present invention is that the top end wall of the container is reinforced by an inclined offset wall between the top end wall and the sidewall, to further resist deformation.

A fourth object and advantage of the present invention is that the top end wall of the container is further reinforced by ribs spaced at intervals around the inclined offset wall.

Another object and advantage of the present invention is that the top end wall of the container is further reinforced by "kiss-offs", i.e., indentations in the sidewall of the container which engage the top end wall and the offset wall.

Another object and advantage of the present invention is that the bottom end wall of the container is reinforced by a removable pressure plate.

Still another object and advantage of the present invention is that the dome-shaped bottom end wall and a recess in the bottom end wall of the container allow nearly 100% retrieval of fluid from the container and complete rinsing and draining.

Another object and advantage of the present invention is that it has standard dimensions approximating those of a standard 55 gal. drum, allowing fitting the container into standard size bulk chemical delivery system cabinets.

Another object and advantage of the present invention is that it is pallet stackable with other containers of similar dimensions.

DETAILED DESCRIPTION OF THE PREFERRED EMBODIMENTS

Figure 1:
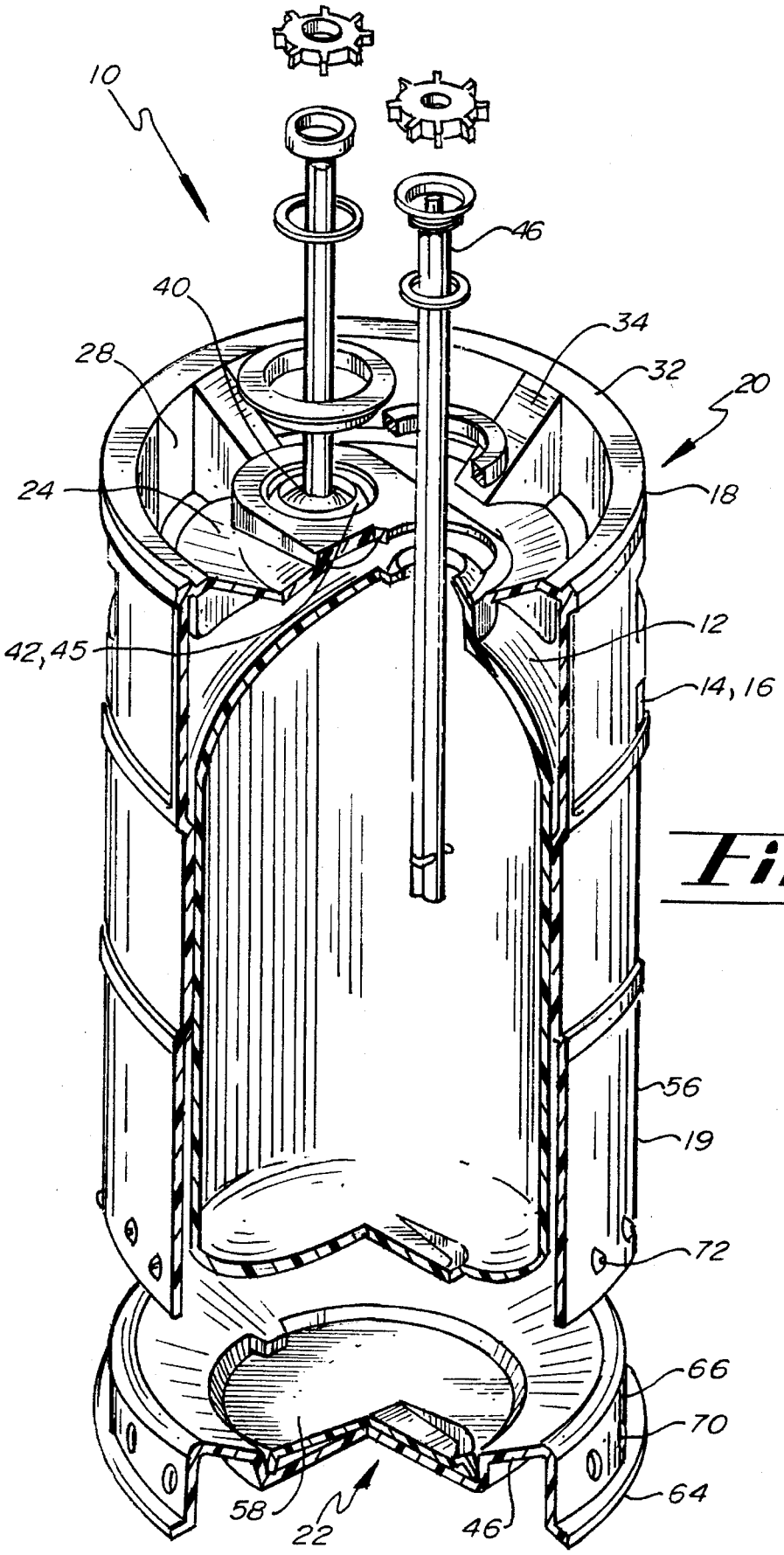
FIG. 1 is a perspective view of the container partially broken away.
Figure 2:
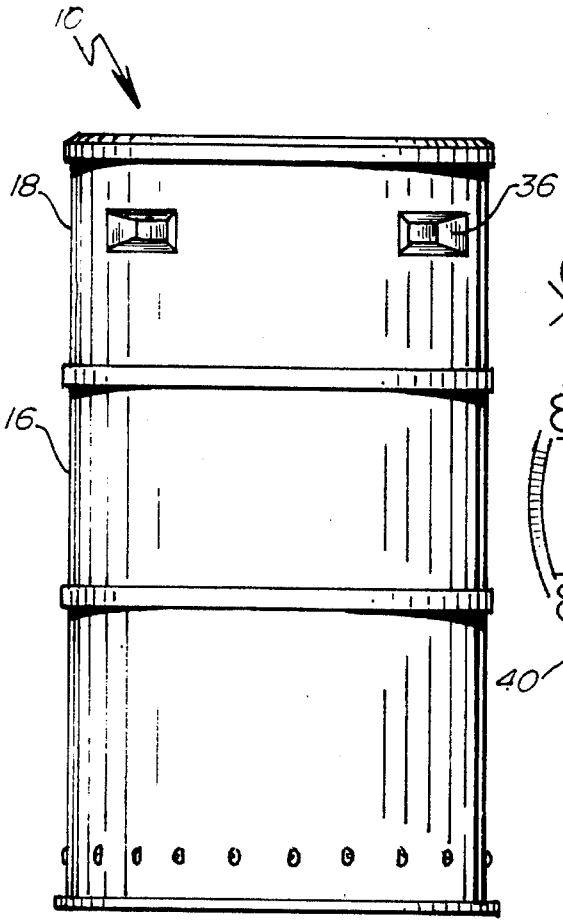
FIG. 2 is a side elevation view of the container.
Figure 3:
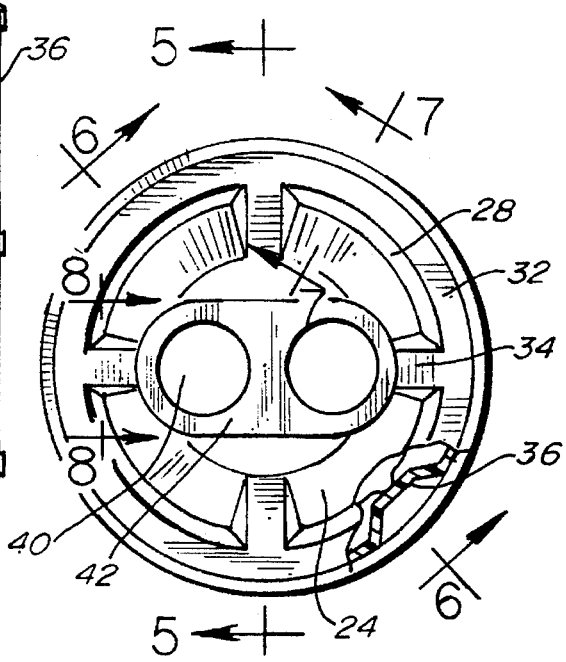
FIG. 3 is a top plan view of the container partially broken away.
Figure 7:
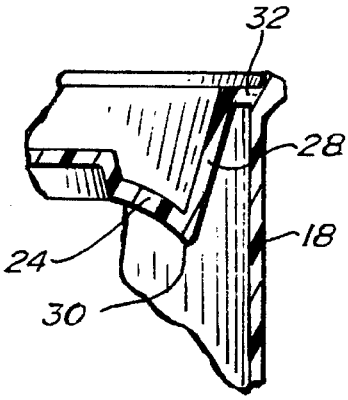
FIG. 7 is a detailed section view taken at 7—7 of FIG. 3.
Figure 4:
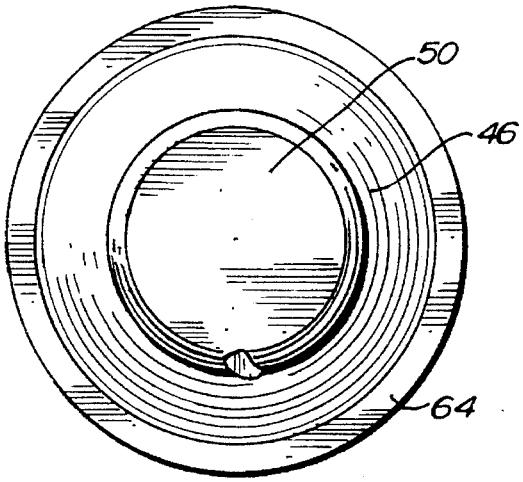
FIG. 4 is a bottom plan view of the container.

A composite, pressure-resistant, drum type container of the present invention is generally shown as the number 10 in the Figures. The container 10 comprises an inner, plastic liner 12 and an elongate outer plastic shell 14 enclosing the inner liner 12. The elongate outer plastic shell 14 further comprises an elongate sidewall 16 having an upper edge portion 18 and a lower end portion 19, a top end structure 20, and a bottom end structure 22 connected to the lower end portion 19 of the sidewall 16. The outer shell 14 may desirably be of substantially cylindrical shape. The inner liner 12 is preferably made of virgin polyethylene and the outer shell 14 is preferably made of UV-stabilized polyethylene. The overall dimensions of the container 10 are preferably about the same size as but no larger than a standard 55 gal. drum.

The top end structure 20 includes a dome-shaped top end wall 24 disposed below the upper edge portion 18 and top edge surface 19 of the sidewall 16. The dome shape of the top end wall 24 resists deformation. The top end wall 24 has a concave inner side 25 facing the interior 26 of the container 10.

Figure 5:
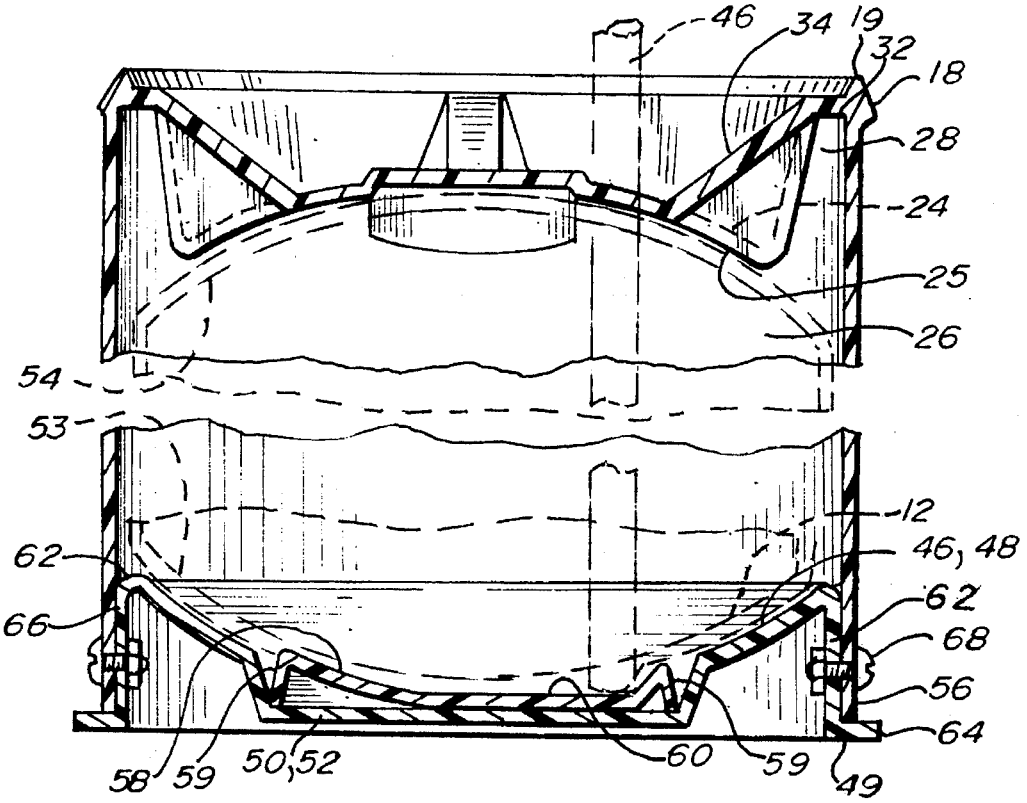
FIG. 5 is a detailed section view taken at 5—5 of FIG. 3.
Figure 6:
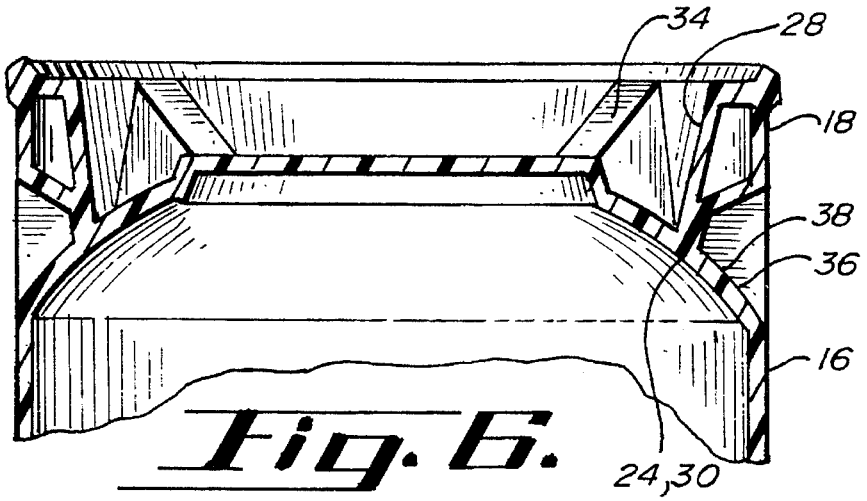
FIG. 6 is a detailed section view taken at 6—6 of FIG. 3.

The top end structure 20 also includes an inclined offset wall 28 which extends around the top end wall 24 between the top end wall 24 and the upper edge portion 18 of the sidewall 16. The offset wall 28 is connected both to the top end wall 24 at its peripheral edge portion 30 and the upper edge portion 18 of the sidewall 16, thereby strengthening the top end wall against the pressure of liquids and vapors in the container 10. In the preferred embodiment, the offset wall 28 tapers convergently toward the top end wall 24, as best seen in FIG. 5. In the preferred embodiment, the shape of the offset wall is generally conical. The top end wall 24 and offset wall 28 are preferably formed integrally of and in one piece with the sidewall 16, as for example by rotational molding.

Figure 8:
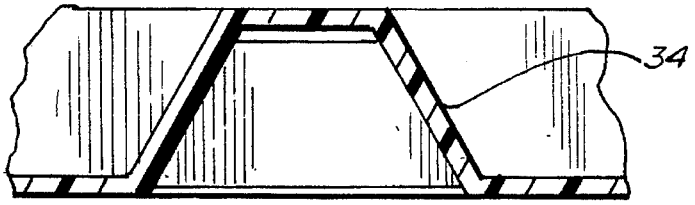
FIG. 8 is a section view taken at 8—8 of FIG. 3.

The offset wall 28 has an upper edge portion 32 and a plurality of rib portions 34 which extend between the upper edge portion 32 of the offset wall 28 and the peripheral edge portions 30 of the top end wall 24. These rib portions 34 further strengthen the top end wall 24 against deformation due to the pressure of the container contents. The rib portions 34 are preferably channel shaped, as best seen in FIG. 8, opening into the interior 26 of the container 10. The rib portions 34 may be inclined with respect to the offset wall 28, as best seen in FIGS. 1 and 5. The upper edge portion 32 of the offset wall 28 forms a substantially flat surface for stacking the container.

To further strengthen the top end wall 24 against deformation, a plurality of deformations or "kiss-offs" 36 are spaced around the sidewall 16 adjacent the upper edge portion 18 of the sidewall 16. These deformations define a plurality of inwardly protruding wall portions 38 which engage the offset wall 28 and the peripheral edge portions 30 of the top end wall 24. Preferably, the inwardly protruding wall portions 38 are formed integrally and of one piece with the offset wall 28 and the top end wall 24. Preferably, the deformations 36 and rib portions 34 are spaced from each other around the periphery of the offset wall 28.

The top end wall 24 has a plurality of openings 40 therethrough for dispensing the fluid contents of the container 10. These openings 40 connect to the inner liner 12 and extend through a panel 42 which is connected to the top end wall 24 and which has a flat outer surface 45. The panel 42 is used for making sealed connections to external dispensing equipment, such as a withdrawing tube 46. The withdrawing tube 46 may be inserted through the panel 42 and one of the openings 40 to access the contents of the container 10.

The bottom end structure 22 includes a dome-shaped bottom end wall 46. As with the top end wall, the dome shape of the bottom end wall resists deformation. The bottom end wall 46 has a concave inner side 48 facing the interior 26 of the container 10. The bottom end wall 46 does not extend beyond the bottom edge surface 49.

A flattened recess 50 facing the interior 26 of the container 10 is formed in the bottom end wall 46, preferably in its center portion 52. The recess 50 does not extend below the lower end portion 56 of the sidewall 16. As seen best in FIG. 5, the dome-shaped bottom end wall 46 is deformed downward near its central portion 52 and then flattened out to produce the recess 50. The dome-shaped end wall 46 is generally shaped to conform to the shape of the lower end 53 of the inner plastic liner 12 and vice-versa. Similarly the shape of the top end wall 24 and the shape of the upper end of the liner 12 conform to each other.

A pressure plate 58 is removably mounted in the recess 50 so as to further strengthen the bottom end wall 46 against deformation. The pressure plate 58 has substantially the same dome-shaped curvature as the bottom end wall 46, thereby forming a substantially concave structure when the pressure plate 58 is mounted in the recess 50. The dome-shaped curved surface of the pressure plate 58 is braced against the flat recess 50 by extensions 59. The pressure plate has a flattened well 60 which conforms to the flattened recess 50 in the bottom end wall 46. The inner liner 12 is molded to conform to the shape of the well 60. As the container 10 is emptied, its fluid contents will drain along the curved surface of the inner liner conforming to the dome-shaped bottom end wall 46 and collect in the flattened well 60 in the pressure plate 58, thereby allowing substantially all of the contents of the container 10 to be removed through a withdrawing tube 46 which rests in the flattened well 60.

The peripheral edge portions 62 of the bottom end wall 46 may be bent downwardly parallel to the lower end portion 56 of the sidewall 16, and then outwardly perpendicular to the lower end portion 56 to form a flange 64 for stacking the container and a ring 66 which slidably mates with the lower end portion 56 of the sidewall 16. The lower end portion 56 of the sidewall 16 is fastened to the ring 66 with bolts 68 through the holes 70 in the ring 66 and matching holes 72 in the lower end portion 56.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. A composite, pressure-resistant, drum type container for fluid, comprising:

an inner plastic liner for receiving fluids, an outer plastic shell enclosing said inner liner, said outer shell having an elongate sidewall having an upper edge portion and a lower end portion, a top end structure adjacent said upper edge portion, and a bottom end structure connected to the lower end portion of said sidewall, said top end structure further comprising a dome-shaped top end wall having a peripheral edge portion adjacent the sidewall, the dome-shaped top end wall having a concave inner side facing the interior of the container and concave with respect thereto and the peripheral edge portion of said dome-shaped top end wall being disposed below the upper edge portion of the sidewall, said top end structure further comprising an offset wall extending around the dome-shaped top end wall and said offset wall extending between the dome-shaped top end wall and the sidewall, the offset wall connected to both of the peripheral edge portion of the dome-shaped top end wall and the upper edge portion of the sidewall thereby resisting the pressure of fluids contained within said container, the container having an opening for receiving and dispensing the fluids.

2. A composite, pressure-resistant, drum type container as in claim 1, wherein the inner side of the dome-shaped top end confronts, engages with, and supports the inner plastic liner.

3. A composite, pressure-resistant, drum type container as in claim 1, wherein the dome-shaped top end wall is formed integrally of and in one piece with the offset wall.

4. A composite, pressure-resistant, drum type container as in claim 1, wherein said offset wall is generally tapering convergently toward the dome-shaped top end wall.

5. A composite, pressure-resistant, drum type container as in claim 1, wherein the top end structure comprises a plurality of rib portions wherein said offset wall comprises an upper edge portion and wherein the plurality of rib portions extend between said upper edge portion of the offset wall and the dome-shaped top end wall for reinforcing the top end wall.

6. A composite, pressure-resistant, drum type container as in claim 5, wherein said rib portions are substantially channel shaped and open into an interior of the container.

7. A composite, pressure-resistant, drum type container as in claim 5 wherein the rib portions are inclined with respect to the offset wall.

8. A composite, pressure-resistant, drum type container as in claim 1, wherein the sidewall has a plurality of wall portions spaced from each other around the sidewall and below the upper edge portion of the sidewall, each of said wall portions connecting to the top end structure whereby reinforcement of the top end wall is provided.

9. A composite, pressure-resistant, drum type container as in claim 8, wherein each of the wall portions is inwardly protruding and each of said inwardly protruding wall portions join with the offset wall portion.

10. A composite, pressure-resistant, drum type container as in claim 9, wherein the top end structure comprises a plurality of rib portions wherein said offset wall comprises an upper edge portion and wherein the plurality of rib portions extend between said upper edge portion of the offset wall and the dome-shaped top end wall for reinforcing the top end wall.

11. A composite, pressure-resistant, drum type container as in claim 9, wherein said inwardly protruding wall portions are formed integrally of and in one piece with said offset wall and said dome-shaped top end wall.

12. A composite, pressure-resistant, drum type container as in claim 10, wherein said rib portions and said inwardly protruding wall portions are spaced from each other around the periphery of said offset wall.

13. A composite, pressure-resistant, drum type container as in claim 9, wherein the inclined offset wall is formed integrally and in one piece with said inwardly protruding wall portions and also with the peripheral edge portions of the dome-shaped top end wall.

14. A composite, pressure-resistant, drum type container, comprising:

an inner liner having a dome-shaped bottom end, an elongate outer plastic shell, enclosing said inner liner, said outer shell having an elongate sidewall having an upper edge portion and a lower end portion, a top end structure adjacent said upper edge portion, and a bottom end structure adjacent to said lower end portion of the sidewall, said bottom end structure further comprising a bottom end wall having an inner side facing the interior of the container and said bottom end wall having a recess facing the interior of the container, and said bottom end structure further comprising a pressure plate positioned in said recess, said pressure plate having substantially the same curvature as the dome-shaped lower end of the inner plastic liner.

15. A composite, pressure-resistant, drum type container as in claim 14, wherein the bottom end wall is dome-shaped and is disposed at or above the lower end portion of the sidewall.

16. A composite, pressure-resistant, drum type container as in claim 14, wherein the peripheral edge portions of said bottom end wall are bent downwardly and outwardly to form a flange for stacking said containers.

17. A composite, pressure-resistant, drum type container, comprising:

an inner plastic liner, an elongate outer plastic shell enclosing said inner liner, said outer shell having an elongate sidewall having an upper edge portion and a lower end portion, a top end structure adjacent said upper edge portion, and a bottom end structure connected to the lower end portion of said sidewall, said top end structure further comprising a dome-shaped top end wall having peripheral edge portions adjacent the sidewall, the dome-shaped top end wall having a concave inner side facing the interior of the container and said dome-shaped top end wall being disposed below the upper edge portion of the sidewall, said top end structure further comprising an inclined offset wall extending around and between the dome-shaped top end wall and the sidewall and connected to both of the peripheral edge portions of the dome-shaped top end wall and the upper edge portion of the sidewall thereby resisting the pressure of liquids and vapors contained within said container, said inclined offset wall generally tapering convergently toward the dome-shaped top end wall, said inclined offset wall comprising an upper edge portion and a plurality of rib portions extending between said upper edge portion of the offset wall and the peripheral edge portions of the dome-shaped top end wall, said upper edge portion of the offset wall forming a substantially flat surface for stacking the container, said rib portions being substantially channel-shaped and open to the interior of the container, and said rib portions being inclined with respect to the offset wall, said sidewall having a plurality of deformations spaced from each other around the sidewall and adjacent the upper edge portion of the sidewall and said deformations defining a plurality of inwardly protruding wall portions engaging the adjacent offset wall and also the peripheral edge portion of the dome-shaped top end wall, said rib portions and said inwardly protruding wall portions being spaced from each other around the periphery of said inclined offset wall, said top end wall further comprising a plurality of openings for dispensing fluids from the container, said inner liner being connected to said openings, and said top end structure further comprising a dispensing panel connected to said top end wall for sealably connecting dispensing equipment to the container, said openings extending through said panel, said bottom end structure further comprising a dome-shaped bottom end wall having peripheral edge portions adjacent the sidewall, the dome-shaped bottom end wall having a concave inner side facing the interior of the container and said dome-shaped bottom end wall having a recess facing the interior of the container, and said bottom end structure further comprising a pressure plate removably mounted in said recess, said pressure plate having substantially the same curvature as the dome-shaped bottom end wall.

18. A composite, pressure-resistant, drum type container as in claim 17, wherein said inclined offset wall is formed integrally and in one piece with said inwardly protruding wall portions and also with the peripheral edge portions of the dome-shaped top end wall.

19. A composite, pressure-resistant, drum type container as in claim 17, wherein said dome-shaped bottom end wall is disposed at or above the lower end portion of the sidewall, and wherein the peripheral edge portions of said bottom end wall are bent downwardly and outwardly to form a flange for stacking said container.

20. A pressure-resistant container for fluids, the container comprising:

a) An inner plastic liner for holding fluids, the plastic liner having an upper and lower dome shaped ends;

b) A generally rigid outer plastic shell to surround and engage the inner plastic liner, the outer plastic shell comprised of:

i) a generally cylindrical sidewall with a upper edge portion and a lower end portion;

ii) top end structure joined to the elongate sidewall, the top end structure interior of the upper edge portion of the elongate sidewall, the top end structure having an exterior outwardly facing and substantially dome-shaped top end wall, the top end wall having a concave inner side generally conforming to the shape of the upper dome-shaped end of the inner plastic liner, iii) bottom end structure joined to the elongate sidewall and comprising an exterior outwardly facing dome-shaped bottom end wall, the bottom end wall having a concave inner side generally conforming to the shape of the lower dome-shaped end of inner plastic liner, c) the container having a top edge surface and a bottom edge surface, the dome shaped top end wall and the dome shaped bottom end wall configured and positioned such that said end walls do not extend beyond said top edge surface and bottom edge surface respectively.

21. The container of claim 20 wherein the domed-shaped top end wall and the dome-shaped bottom end wall both contact and engage the plastic liner.

22. A composite, pressure-resistant, drum type container for fluid, comprising:

an inner plastic liner for receiving fluids, an outer shell enclosing said inner liner, said outer shell having a substantially cylindrical sidewall having an edge portion, and an end structure adjacent said edge portion, said end structure further comprising an end wall having a peripheral edge portion disposed adjacent the edge portion of the sidewall, and said end structure further comprising an offset wall extending around the end wall and extending between the end wall and the sidewall, the offset wall connected to both of the peripheral edge portions of the end wall and the edge portion of the sidewall, and the elongate sidewall having a plurality of wall portions spaced from each other around the sidewall and adjacent the edge portion of the sidewall, each of said wall portions connecting to the end structure whereby reinforcement of the end wall is provided.

23. A pressure-resistant container for fluids, the container as in claim 22, wherein each of the wall portions is inwardly protruding and each of said inwardly protruding wall portions join with the offset wall portion.

* * * * *

UNITED STATES PATENT AND TRADEMARK OFFICE

CERTIFICATE OF CORRECTION

PATENT NO. : 5,597,085

DATED : January 28, 1997

INVENTOR(S) : Rauworth, Barry L., et al

It is certified that error appears in the above-indentified patent and that said Letters Patent is hereby corrected as shown below:

Column 4, line 20, after "end" (second occurrence), insert --54--.

Signed and Sealed this

Fourth Day of November, 1997

Bruce Lehman

*Attest:*

BRUCE LEHMAN

*Attesting Officer*

*Commissioner of Patents and Trademarks*